United States Patent [19]

Petty

[11] 4,187,758

[45] Feb. 12, 1980

[54] BOMB CONTAINER WITH GRAVITY-CLOSED INTERNAL DOOR

[75] Inventor: Jon Petty, Newton, N.J.

[73] Assignee: The United States of America as represented by the Secretary of the Army, Washington, D.C.

[21] Appl. No.: 866,667

[22] Filed: Jan. 3, 1978

[51] Int. Cl.[2] ..... F42B 33/00

[52] U.S. Cl. ..... 86/1 B; 109/74; 220/244

[58] Field of Search ..... 86/1 B; 312/311, 312, 312/313; 220/244; 109/64, 65, 66, 68, 74, 49.5

[56] References Cited

U.S. PATENT DOCUMENTS

| | | | |
|---|---|---|---|
| 895,581 | 8/1908 | Nygreen | 109/64 |
| 1,087,885 | 2/1914 | Malloy | 220/244 |
| 1,870,973 | 8/1932 | Thwaits | 220/244 |
| 1,924,279 | 8/1933 | Harter | 220/244 |
| 2,026,799 | 1/1936 | Ragonnet | 220/244 |
| 2,615,693 | 10/1952 | Matirko | 220/244 |
| 3,229,845 | 1/1966 | Sjoholm et al. | 220/244 |
| 3,820,435 | 6/1974 | Rogers | 86/1 B |
| 3,820,479 | 6/1974 | Fylling | 86/1 B |
| 4,027,601 | 6/1977 | Hickerson | 86/1 B |

*Primary Examiner*—Harold J. Tudor

*Attorney, Agent, or Firm*—Nathan Edelberg; Robert P. Gibson; A. Victor Erkkila

[57] ABSTRACT

The bomb container comprises: a hollow steel spherical housing, mounted on a trailer vehicle, having a single circular access port to which is welded a massive steel re-inforcing ring; a circular steel plate door disposed within the housing with its outer peripheral face normally fitting the inner face of the ring to close the port; an external hinge for hingeing the door to the housing to swing inwardly and open the port comprising two spaced hinge lugs attached to the outside of the loop, at the top thereof, a third hinge lug hinged to the first two hinge lugs, and a U-shaped hinge extension arm having an upper end attached to the first two hinge lugs and a lower end welded to the outer face of the door; and a safety operating arm attached to the third hinge lug at one end and extending upwardly and over the housing and down the side thereof opposite the port, for opening and closing the door, and for normally keeping it closed by gravity. The housing contains a bomb rack hinged to the rear wall, opposite the port, and cables or ropes attached to the rack and extending through the housing for supporting the rack or lowering it to receive a bomb.

3 Claims, 4 Drawing Figures

BOMB CONTAINER WITH GRAVITY-CLOSED INTERNAL DOOR

GOVERNMENTAL INTEREST

The invention described herein may be manufactured, used and licensed by or for the Government for governmental purposes without payment to me of any royalty thereon.

BACKGROUND AND SUMMARY OF THE INVENTION

The present invention relates to a new and improved container for safely transporting a bomb or other explosive device to a safe disposal area.

There are basically three types of bomb containers in use today by police bomb squads. The first type is a cylinder open at the top and closed at the bottom. The second is similar to the first except that it is open both at the top and bottom. The third type consists of a woven wire blasting mat formed into a container. At most, these known bomb containers only attenuate or direct an explosive blast and fragmentation from a detonation. In the cylinder types of containers, the fragments are directed up and/or down while the blast pressure propagates in a spherical shape away from the cylinder. In the woven wire container, most of the fragments are stopped by the wire, but the blast pressure will propagate through the wire. There is a high likelihood of personal injury or property damage in the immediate vicinity of these types of bomb containers in the event of an accidental explosion.

More elaborate bomb container's having external doors similar to those used on safe vaults have been proposed. However, such external doors, if provided with hinges and locks capable of containing the explosion of a large bomb, are very expensive and slow-acting in opening and closing.

An object of the present invention is to provide an improved bomb container, having a relatively simple, gravity-closed, inwardly-opening door, capable of safely containing the explosion of any bomb likely to be placed therein for transportation to a safe disposal area.

In accordance with the invention, the improved bomb container comprises: a strong housing, e.g., a hollow steel sphere, having a single access port reinforced by a massive loop of strong material; a strong door disposed within the housing with the outer face of its periphery normally fitting the inner face of the loop to close the port; external means for hingeing the door to the housing to swing inwardly and open the port comprising a first hinge lug attached to the outside of the loop, a second hinge lug hinged to the first hinge lug, and a U-shaped hinge extension arm having one end attached to the second hinge lug and the other end attached to the outer face of the door; and a safety operating arm attached to the second hinge lug at one end and extending upwardly and over the housing and down the side thereof opposite the port, for opening and closing the door, and normally keeping it closed by gravity. Preferably, the housing contains a bomb rack hinged to the rear wall, opposite the port, and tensile means, attached to the rack and extending upwardly through the housing, for supporting the rack or lowering it to receive a bomb.

DETAILED DESCRIPTION OF THE INVENTION

Figure 1:
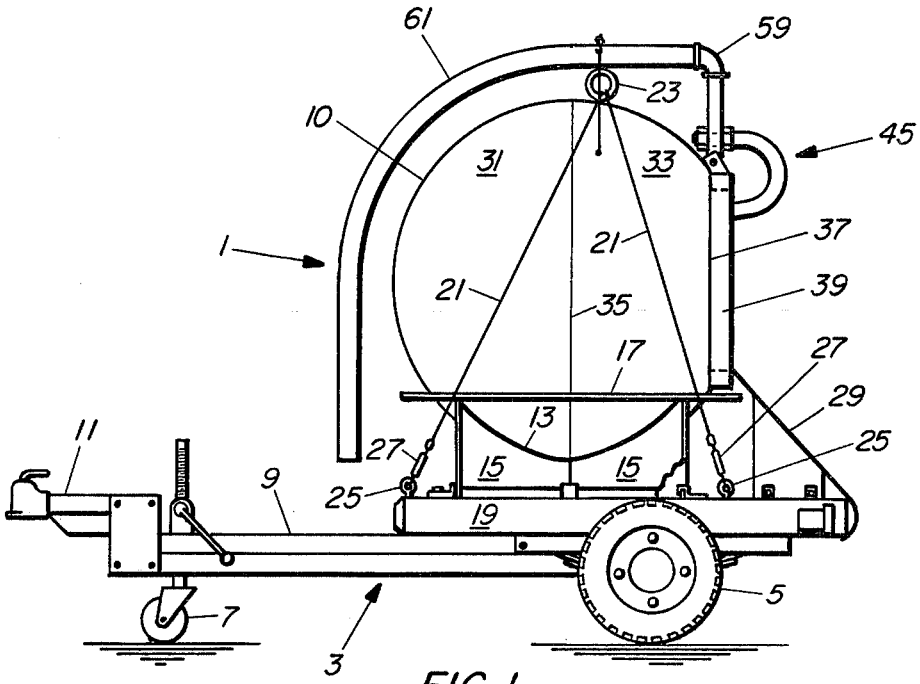
FIG. 1 is a side elevation view of a bomb container embodying the present invention, mounted on a trailer vehicle.

FIGS. 1 to 4 show an example of a bomb container 1 embodying the present invention, mounted on a trailer vehicle 3. As shown in FIG. 1, the trailer 3 may comprise main wheels 5, an adjustable front wheel 7, a bedplate 9, and a tongue 11. The bomb container 1 comprises a housing 10, which is preferably spherical in shape and rests on a spherical seat 13 formed by at least three vertical plates 15 and an annular plate 17 mounted on a flat platform 19 attached to the trailer bedplate 9. The housing 10 is held down on the spherical rest 13 by a plurality of cables 21 attached at one end to a lifting ring 23 welded to the top of the housing and at the other end to the platform 19 by eye bolts 25 and turnbuckles 27. The trailer 3 may also include an inclined ramp 29 attached to the rear end of the platform 19 for use in loading a bomb into the container 1.

The housing 10 is preferably made by welding two hemispherical sections 31 and 33 of steel together at 35 (FIG. 1) to form a hollow sphere. The section 31 is solid, while the section 33 is formed with a single circular access port or opening 37. A massive steel ring 39 is disposed within the port 37, and rigidly welded, at 41, around it periphery to the housing part 33. The bomb container 1 is mounted on the trailer 3 with the port 37 and ring 39 facing rearwardly, as shown in FIG. 1.

Figure 3:
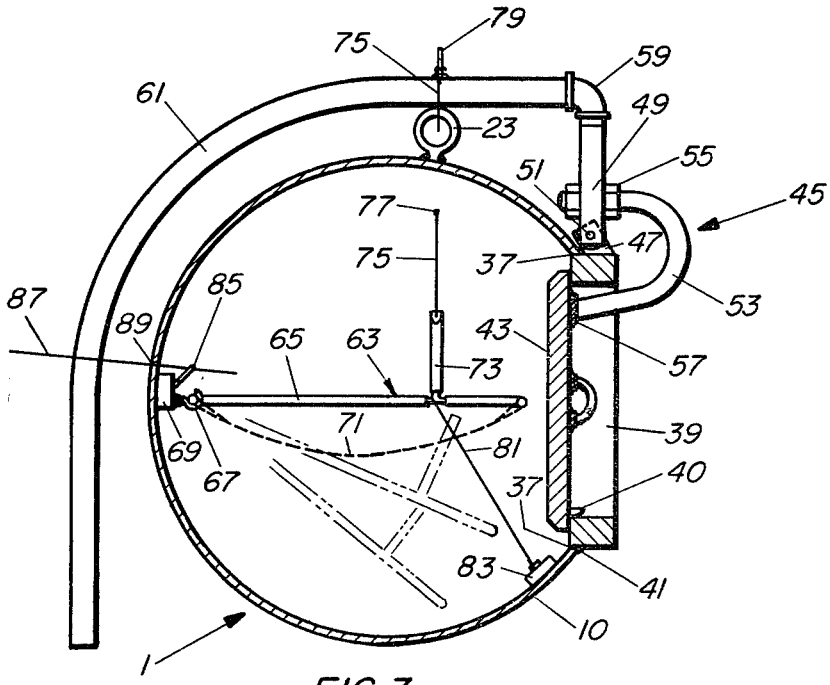
FIG. 3 is a view of the bomb container of FIGS. 1 and 2, partly in section along the line 3—3 of FIG. 2, with the container door closed.
Figure 2:
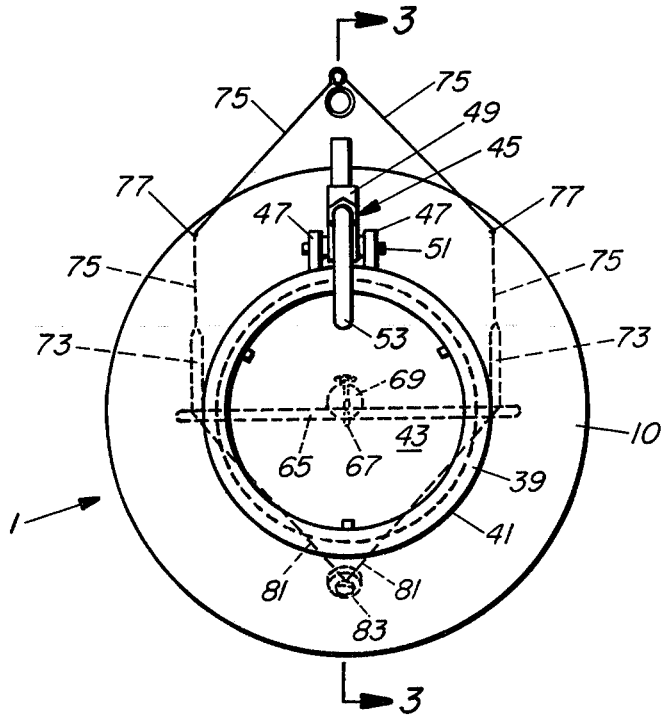
FIG. 2 is a rear view of the bomb container of FIG. 1.

The port 37 is normally closed by an interior door 43, in the form of a massive flat circular steel plate or disc the periphery of which engages the internal face of the ring 39 with a tight fit, by means of locating lug 40, as shown in FIG. 3. The door 43 is hingedly mounted for inward-opening, to load a bomb into the container 1, by an external hinge 45. Hinge 45 comprises a pair of spaced hinge lugs 47 welded to the upper side of ring 39, a hinge lug or rod 49 extending between the hing lugs 47 and hinged thereto by a hinge pin 51, and a U-shaped hinge extension arm 53 having its upper end bolted at 55 to hinge rod 49 and its lower end extending through the ring 39 and welded at 57 to the outer face of the door 43.

The relative positions of the door 43 and hinge 45 are such that the weight of the door normally keeps the door closed by gravity. In addition, the hinge rod 49 is connected, by a pipe fitting (elbow) 59, to an arcuate or L-shaped operating arm or pipe 61, which extends over the top of the housing 10, away from the hinge 45 and door 43, and then downwardly across the housing 10, as shown. This arm 61 not only permits an operator to open and close the door 43 from a safe position remote from the door, to permit insertion of a bomb into the container 1, but also adds to the gravity-closing effect of the door, with or without additional door-closing pressure on the arm by the operator while the bomb is in the container.

Figure 4:
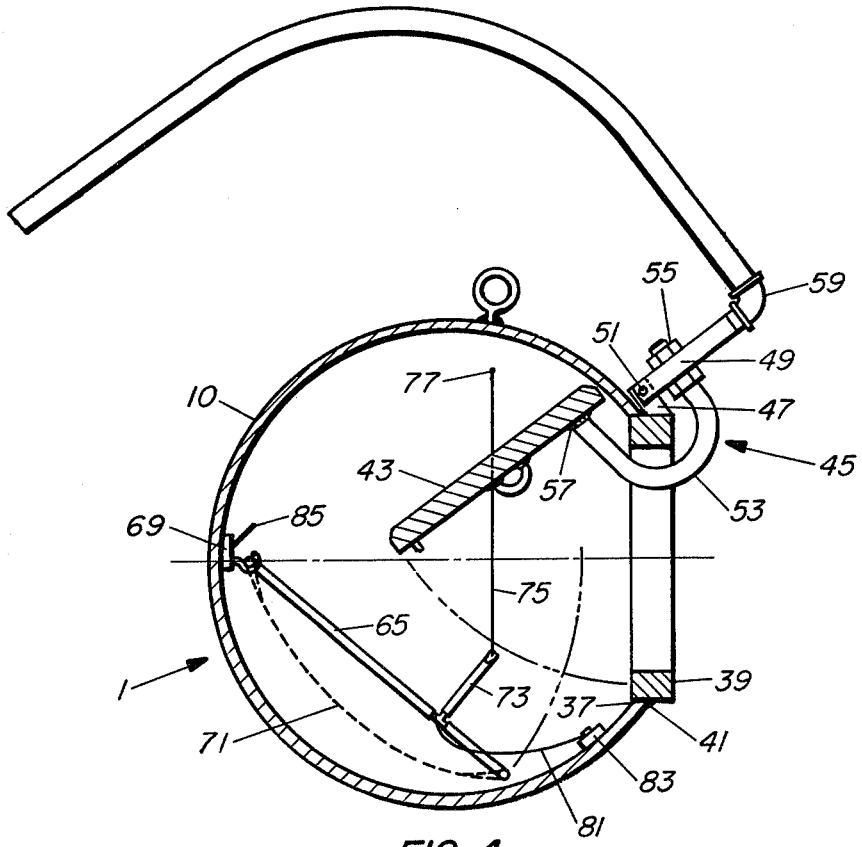
FIG. 4 is a view similar to FIG. 3, with the door open to receive a bomb.

The housing 10 is provided with a bomb rack 63 comprising an annular frame 65 pivoted at one side on a hook 67 mounted on a block 69 attached to the wall of the housing opposite the door 43, and a concave holder or net 71 attached at its periphery to the frame 65. Two upstanding rods 73, attached to the frame 65, have cables or ropes 75 attached thereto that extend upwardly, through small holes 77 in the housing 10, and are connectable to an eye bolt 79 mounted on the operating arm 61, for holding the bomb rack 63 in a horizontal position spaced from the housing walls when the door 43 is closed, as shown in FIG. 3, and for lowering the rack out of the path of the door 43, with the cables removed from the eyebolt 79, as shown in FIG. 4, to permit loading and unloading of the bomb. The bomb container may also be provided with two restrainer cables or ropes 81 attached at the lower ends to a block 83 on the housing 10 and at the upper ends to the sides of the frame 65 of the bomb rack, to limit the upward movement of the rack to the horizontal position of FIG. 3. An eyebolt 85 may be mounted on the block 69 to guide a cable or rope 87, a fragment of which is shown in FIG. 4, passing through a small hole 89 in the housing wall, for safely pulling a bomb up a ramp, such as ramp 29, and into the container housing 10.

What is claimed is:

1. A bomb container comprising a housing strong enough to contain the explosion products of an accidental explosion of an explosive device placed therein, said housing being closed except for a single access port therein;

a massive loop of strong material attached to the wall of said housing around the periphery of said port;

a massive door of strong material disposed within said housing with the outer face of its periphery normally fitting the inner face of said loop, to close said port;

means, external to said housing, for hingeing said door on said housing to swing inwardly and open said port, comprising a first hinge lug attached to the outside of said loop, a second hinge lug hinged to said first hinge lug, a hinge extension arm of U-shape having one end attached to said second hinge lug and the other end attached to the outer face of said door;

a safety operating arm attached to said second hinge lug at one end and extending over the top and down the back side of said housing, and said housing is spherical and is normally supported with said door disposed in a substantially vertical plane and with said hinge lugs located at the top thereof; whereby the weight of said door and of said operating arm keep said door normally closed.

2. A bomb container as in claim 1, wherein:

said housing is spherical and is normally supported with said door disposed in a vertical plane and with said hinge lugs located at the top thereof; and said operating arm extends over the top and down the back side of said housing;

whereby the weight of said door and of said operating arm keep said door normally closed.

3. A bomb container as in claim 2, further comprising:

a bomb tray within said housing;

means pivotally connecting one side of said tray to said housing opposite said port; and tensile means, attached to said tray and extending through the upper wall of said housing, for normally supporting said tray in a central horizontal position, and for lowering the front side of said tray to permit opening of said door to receive a bomb.

* * * * *